US005975192A

United States Patent [19]

Moratalla et al.

[11] Patent Number: 5,975,192

[45] Date of Patent: Nov. 2, 1999

[54] ATTIC AIR CONDITIONING SYSTEM

[76] Inventors: Jose M. Moratalla, 3359 Lake Shore La., Clearwater, Fla. 33761; Paul E. Flasher, 929 Terra Mar Dr., Tampa, Fla. 33613

[21] Appl. No.: 08/953,737

[22] Filed: Oct. 20, 1997

[51] Int. Cl.[6] ..... F28D 3/00

[52] U.S. Cl. ..... 165/45; 165/288; 165/DIG. 905; 165/48.1; 165/297; 165/104.25; 62/260

[58] Field of Search ..... 165/45, 104.33, 165/104.25, 48.1, 176, 297, 905; 62/260

[56] References Cited

U.S. PATENT DOCUMENTS

| | | | |
|---|---|---|---|
| 1,944,992 | 12/1932 | Miller | 165/45 |
| 2,181,953 | 3/1936 | Usselman | 165/45 |
| 3,259,181 | 7/1966 | Ashley et al. | 165/104.25 |
| 3,411,571 | 11/1966 | Lawrence | 165/104.25 |
| 3,526,270 | 11/1966 | Norton | 165/104.25 |
| 4,254,818 | 3/1981 | Melamed | 165/45 |
| 4,448,237 | 5/1984 | Riley | 165/45 |
| 4,448,238 | 5/1984 | Singleton et al. | 165/45 |
| 4,498,526 | 2/1985 | Arenas | 165/45 |
| 5,178,124 | 1/1993 | Lu et al. | 165/176 |
| 5,183,102 | 2/1993 | Clark | 165/48.1 |
| 5,335,708 | 8/1994 | Murakami et al. | 165/297 |
| 5,348,076 | 9/1994 | Asakawa | 165/104.33 |

*Primary Examiner*—Ira S. Lazarus
*Assistant Examiner*—Terrell McKinnon

[57] ABSTRACT

An air conditioning system comprising a chamber with a heated air space at a first temperature; a heat sink located in proximity to the chamber, the heat sink being provided with cooled media at a second temperature lower than the first temperature; a plastic heat exchanger located within the chamber with an associated fan for the movement of air within the chamber across the heat exchanger; and a plurality of plastic lines coupling the heat exchanger and the cooled media, the lines including a first line to convey water from the heat exchanger in the chamber to the cooled media and a second line to convey water from the cooled media to the heat exchanger in the chamber with an associated pump to effect the flow of water in a closed loop configuration between the cooled media and the heat exchanger whereby the heated chamber air space will be cooled to a lower temperature from the cooled water from the cooled media while the temperature of the cooled media will be heated to a higher temperature from the heated chamber air space.

13 Claims, 9 Drawing Sheets

Fig. 6A
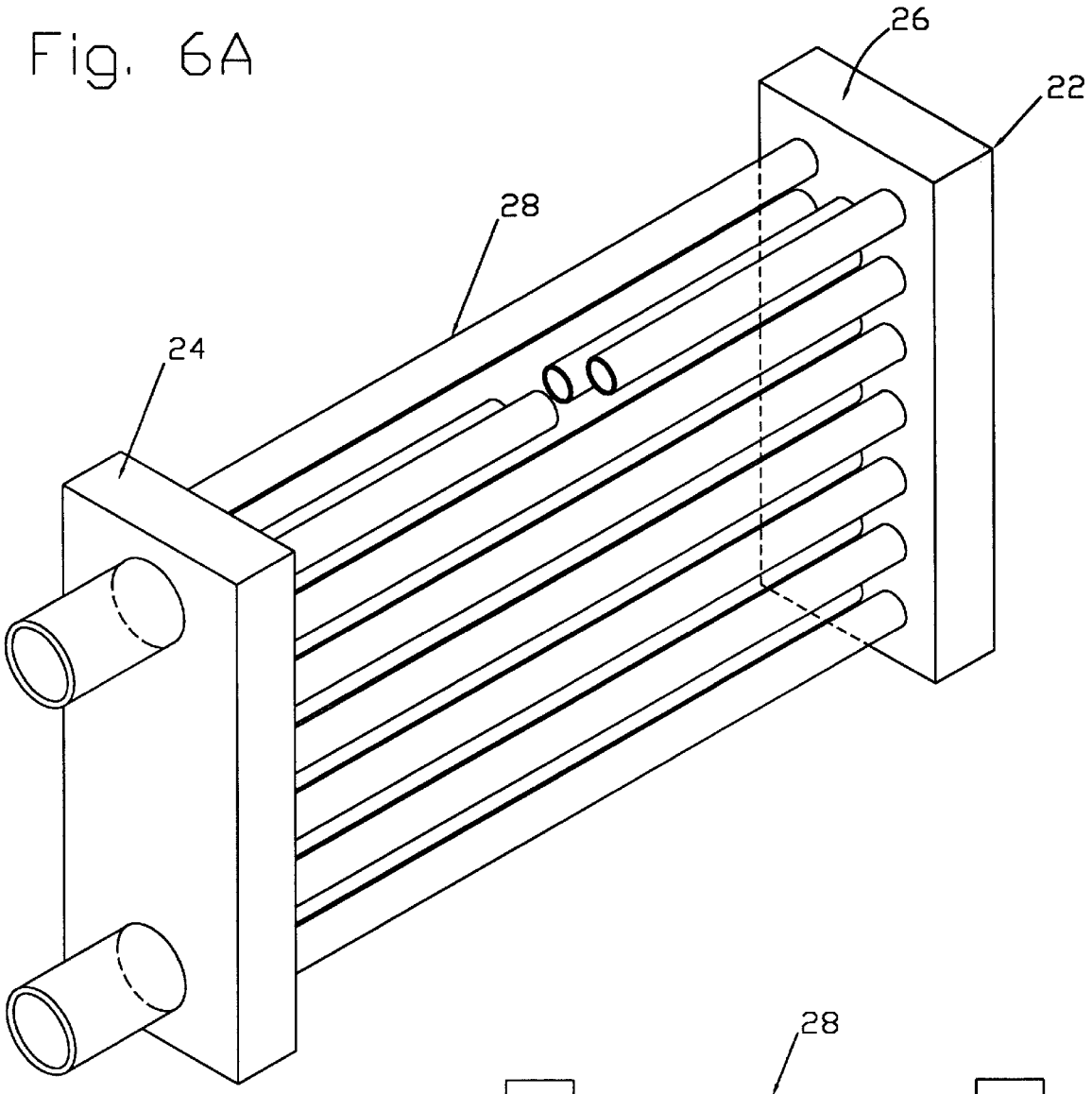
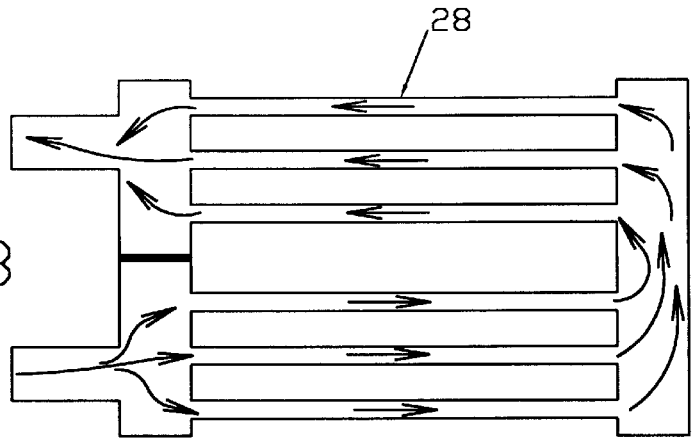
Fig. 6B

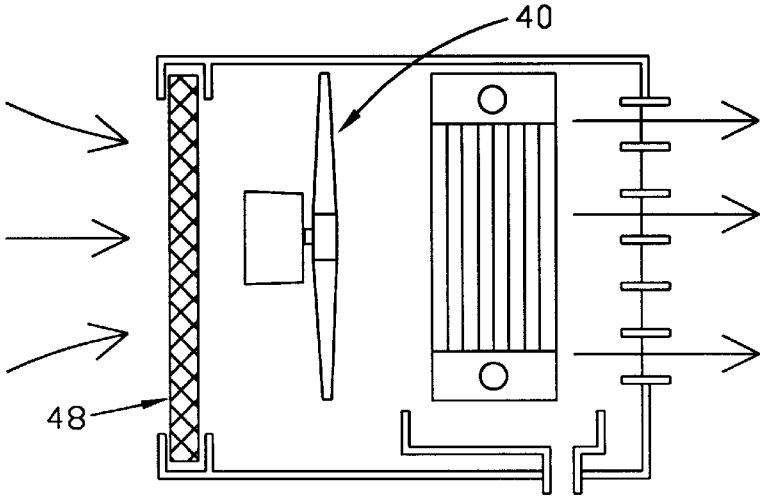
Fig. 7
Fig. 8
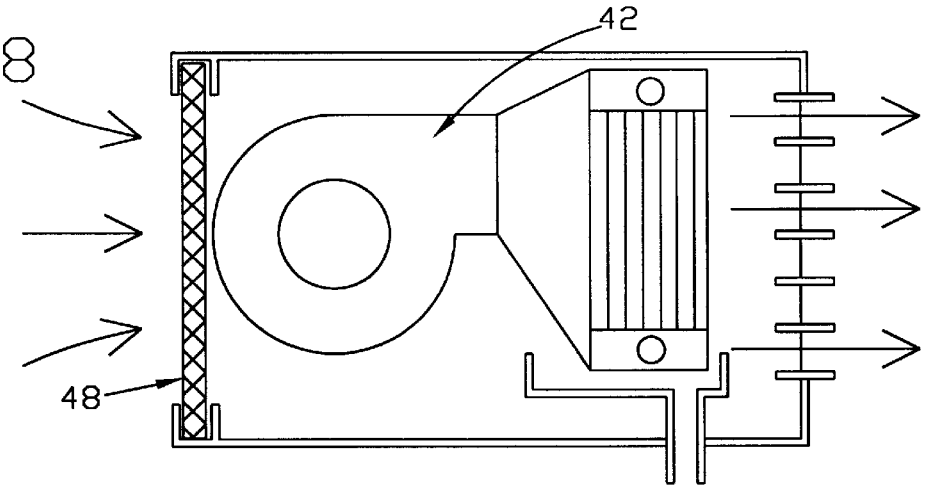
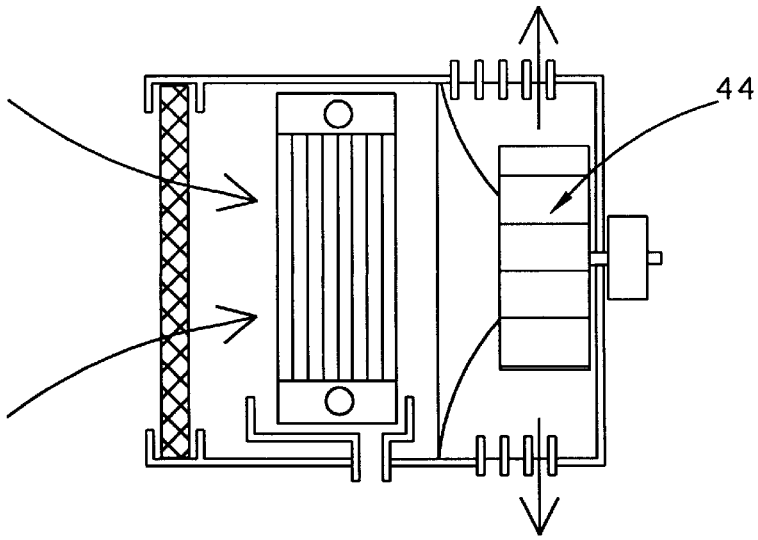
Fig. 9

ATTIC AIR CONDITIONING SYSTEM

BACKGROUND OF THE INVENTION

1. Field of the Invention

The present invention relates to a new and improved attic air conditioning system and, more particularly, pertains to an attic air conditioning system and, more particularly, to using cooler swimming pool water to cool hotter attic air.

2. Description of the Prior Art

The use of air conditioning systems of various designs and configurations is known in the prior art. More specifically, air conditioning systems heretofore devised and utilized for the purpose of cooling houses are known to consist basically of familiar, expected, and obvious structural configurations, notwithstanding the myriad of designs encompassed by the crowded prior art which has been developed for the fulfillment of countless objectives and requirements.

The prior art discloses a number of air conditioning systems and other heat varying devices. By way of example, U.S. Pat. No. 5,014,770 to Palmer, issued May 14, 1991 and assigned to Attic Technology, Inc. discloses an attic solar energy vehicle functioning to heat swimming pool water through metal pipes and solar energy collectors.

In this respect, the attic air conditioning system according to the present invention substantially departs from the conventional concepts and designs of the prior art, and in doing so provides an apparatus primarily developed for the purpose of cooling hotter attic air from cooler swimming pool water.

Therefore, it can be appreciated that there exists a continuing need for a new and improved attic air conditioning system which can be used for cooling hotter attic air through cooler swimming pool water. In this regard, the present invention substantially fulfills this need.

SUMMARY OF THE INVENTION

In view of the foregoing disadvantages inherent in the known types of air conditioning systems now present in the prior art, the present invention provides a new and improved attic air conditioning system. As such, the general purpose of the present invention, which will be described subsequently in greater detail, is to provide a new and improved attic air conditioning system and methods which have all the advantages of the prior art and none of the disadvantages.

To attain this, the present invention essentially comprises a house having a living chamber with an imperforate roof located thereabove, the roof constituting the upper extent of the house with an entrapped heated attic air space located between the roof and the living chamber at a first temperature; a swimming pool located in proximity to the house, the swimming pool being provided with a quantity of chlorinated cooled water at a second temperature lower than the first temperature; a plastic heat exchanger located in the attic with an associated fan for the movement of air within the heated attic air space across the heat exchanger; a drain pan positioned below the heat exchanger and having a drainage outlet for directing condensation generated by the heat exchanger to a location exterior of the house; a plurality of plastic lines coupling the heat exchanger and the cooled water of the swimming pool, the lines including a first line with an open end in fluidic communication with the pool to convey cooled water from the heat exchanger in the attic to the swimming pool and a second line with an open end in fluidic communication with the pool to convey water from the swimming pool to the heat exchanger in the attic with an associated pump to effect the flow of water in a closed loop configuration between the swimming pool and the heat exchanger whereby the entrapped heated attic air space will be cooled to a lower temperature from the cooled water of the swimming pool while the temperature of the cooled water in the swimming pool will be heated to a higher temperature from the heated attic air space; an interconnect pipe connected between the first line and the second line at a point between the pump and the heat exchanger for allowing fluidic communication between the first line and the second line at a location distant the swimming pool and exterior of the attic; a control valve mounted at an interconnection between the second line and the interconnect for selectively redirecting the flow of cooled water from the swimming pool through the interconnect pipe for discharging into the swimming pool thereby bypassing the heat exchanger; a first temperature sensor mounted adjacent the heat exchanger for detecting a first temperature of the air flowing past the heat exchanger; a second temperature sensor mounted on the second line between the open end and the pump for detecting a second temperature of the cooled water entering the heat exchanger from the swimming pool; control means connected between the valve, first temperature sensor and second temperature sensor, the control means adapted to govern the control valve for allowing the flow of cooled water redirected from the swimming pool through the interconnect pipe while precluding the flow of cooled water directed from the swimming pool to the heat exchanger upon at least one of the second temperature deviating from a predetermined amount and a temperature differential between the first temperature and the second temperature deviating from a predetermined range, the control means further adapted to govern the control valve for precluding the flow of cooled water redirected from the swimming pool through the interconnect pipe while allowing the flow of cooled water directed from the swimming pool to the heat exchanger when the second temperature is approximately equal to a predetermined amount and the temperature differential between the first temperature and the second temperature is within the predetermined range; a check valve mounted on the first line between the heat exchanger and the interconnect for permitting only one way flow of the water through the first line, second line, and interconnect; a filter situated on the second line between the second temperature sensor and the open end thereof to prevent particles from entering the pump and further collecting the same for subsequent removal; and chemical treatment means positioned on the first line between the interconnect and the open end thereof for adding a predetermined amount of a chemical substance to the water flowing therepast.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved attic air conditioning system which has all the advantages of the prior art air conditioning systems and none of the disadvantages.

It is another object of the present invention to provide a new and improved attic air conditioning system which may be easily and efficiently manufactured and marketed.

It is a further object of the present invention to provide a new and improved attic air conditioning system which is of a durable and reliable construction.

An even further object of the present invention is to provide a new and improved attic air conditioning system which is susceptible of a low cost of manufacture with regard to both materials and labor, and which accordingly is then susceptible of low prices of sale to the consuming public, thereby making such a attic air conditioning system economically available to the buying public.

Even still another object of the present invention is to cool hotter attic air through cooler swimming pool air.

Lastly, it is an object of the present invention to provide an air conditioning system comprising a chamber with a heated air space at a first temperature; a heat sink located in proximity to the chamber, the heat sink being provided with cooled media at a second temperature lower than the first temperature; a plastic heat exchanger located within the chamber with an associated fan for the movement of air within the chamber across the heat exchanger; and a plurality of plastic lines coupling the heat exchanger and the cooled media, the lines including a first line to convey water from the heat exchanger in the chamber to the cooled media and a second line to convey water from the cooled media to the heat exchanger in the chamber with an associated pump to effect the flow of water in a closed loop configuration between the cooled media and the heat exchanger whereby the heated chamber air space will be cooled to a lower temperature from the cooled water from the cooled media while the temperature of the cooled media will be heated to a higher temperature from the heated chamber air space.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIGS. 6A & 6B are illustrations of the heat exchanger of the preferred embodiment.

FIGS. 7–9 are cross-sectional views of various alternate embodiments of the fan associated with the heat exchanger.

The same reference numerals refer to the same parts throughout the various figures.

Description of the Preferred Embodiment

Figure 11A:
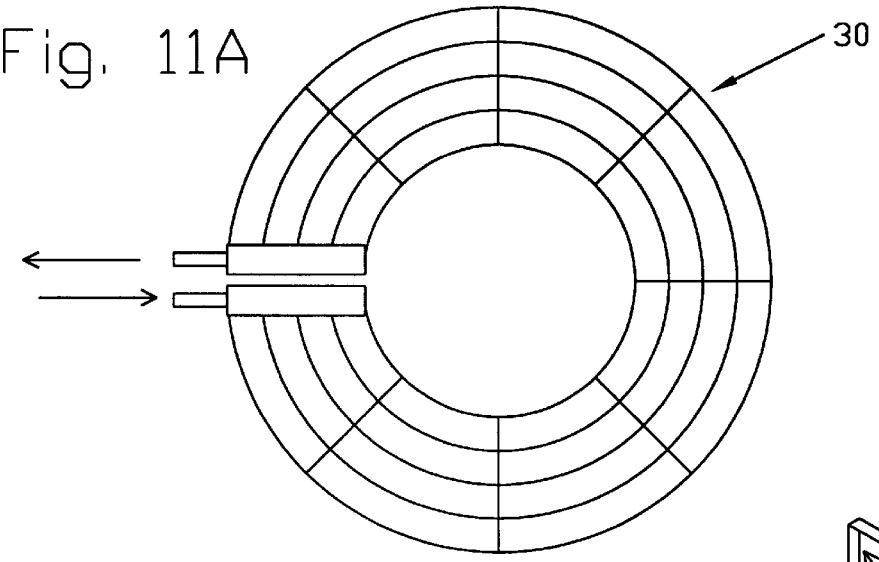
FIGS. 11A–12 are views of various alternate forms of the heat exchanger.
Figure 11B:
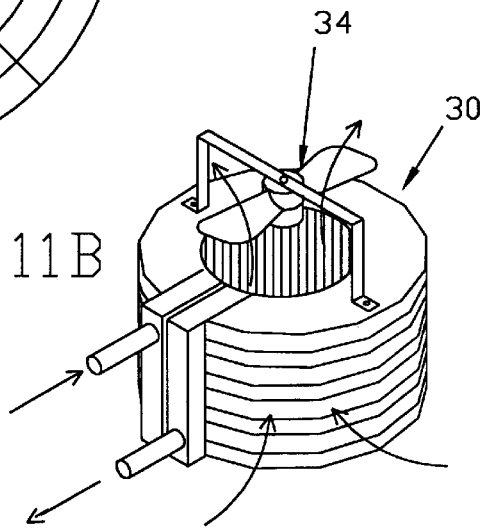
Figure 12:
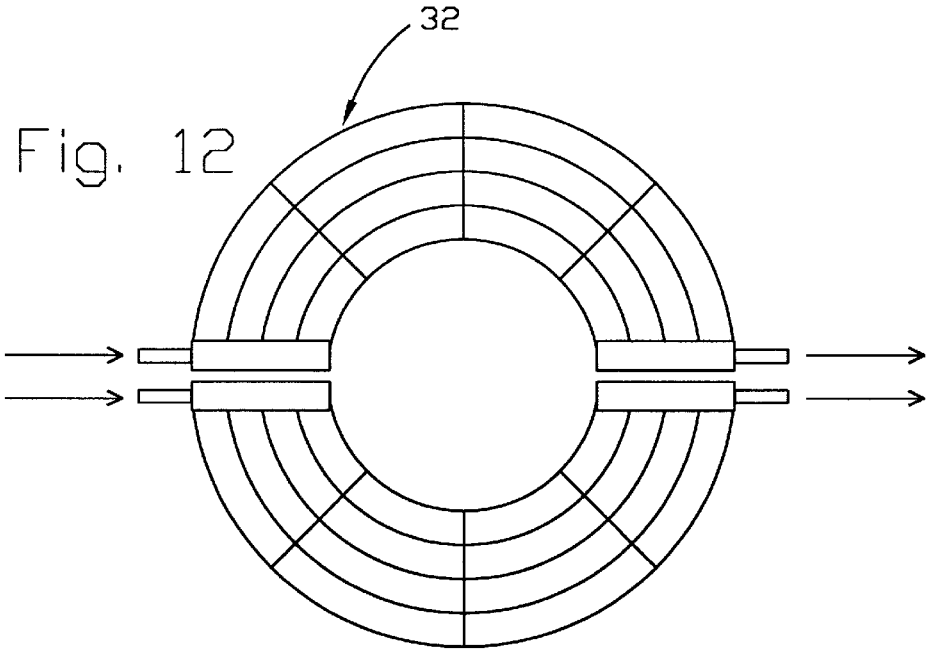

With reference now to the drawings, and in particular to FIGS. 11–12 thereof, the preferred embodiment of the new and improved attic air conditioning system embodying the principles and concepts of the present invention and generally designated by the reference numeral 10 will be described.

The present invention, the new and improved attic air conditioning system is a system 10 comprised of a plurality of components. Such components, in their broadest context, include a heat sink, heat exchanger, pump, interconnect, control valve and control means. Each of the individual components is specifically configured and correlated one with respect to the other so as to attain the desired objectives.

Figure 1:
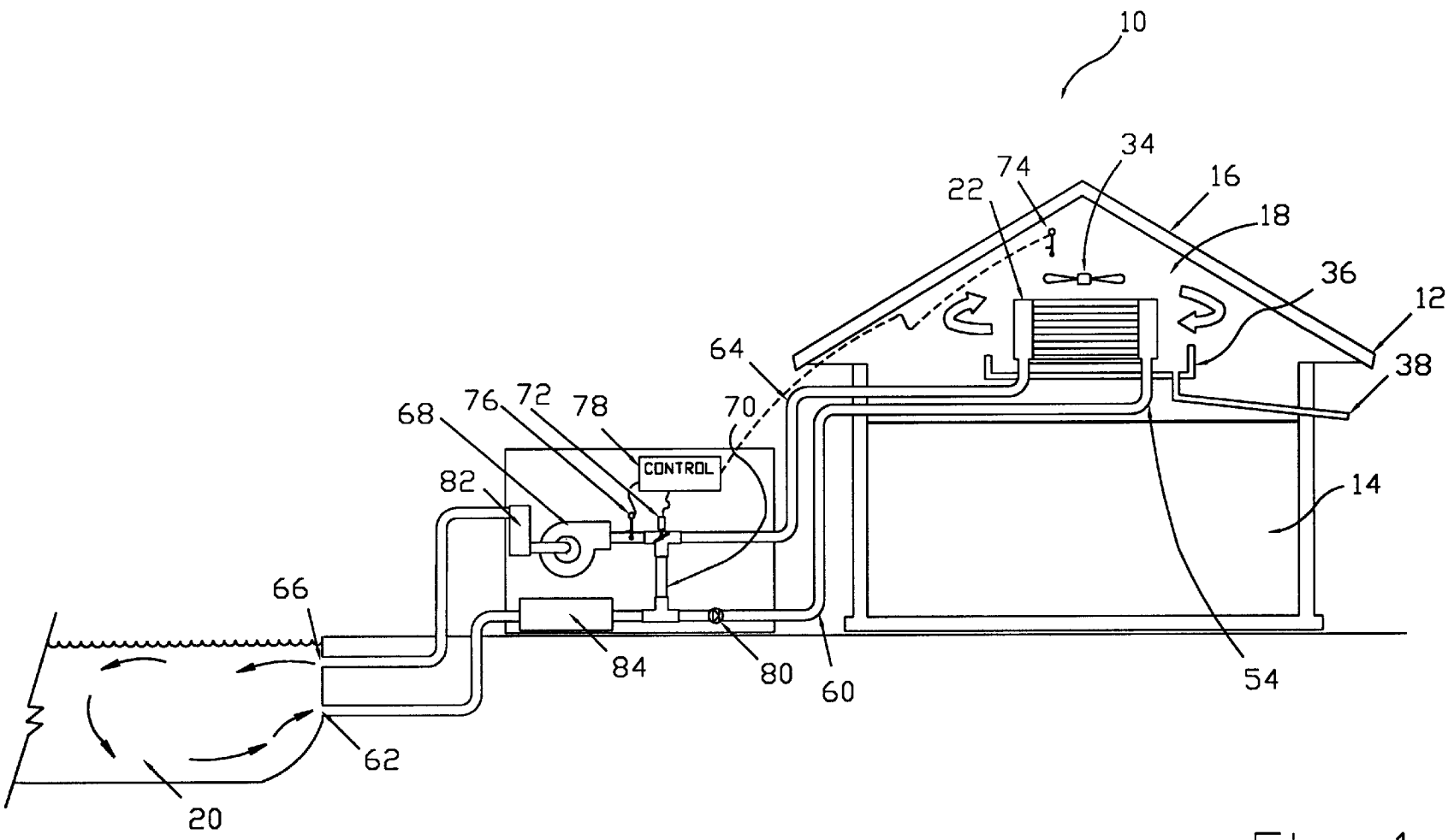
FIG. 1 is a front view of the preferred embodiment of a new and improved attic air conditioning system constructed in accordance with the principles of the present invention.

More specifically, the system 10 of the present invention includes a house 12 having a living chamber 14 with an imperforate roof 16 located thereabove. FIG. 1 shows that the roof constitutes the upper extent of the house. An entrapped heated attic air space 18 is located between the roof and the living chamber at a first temperature.

Next provided is a swimming pool 20 located in the proximity of the house. The swimming pool is provided with a quantity of chlorinated cooled water at a second temperature lower than the first temperature.

Figure 4:
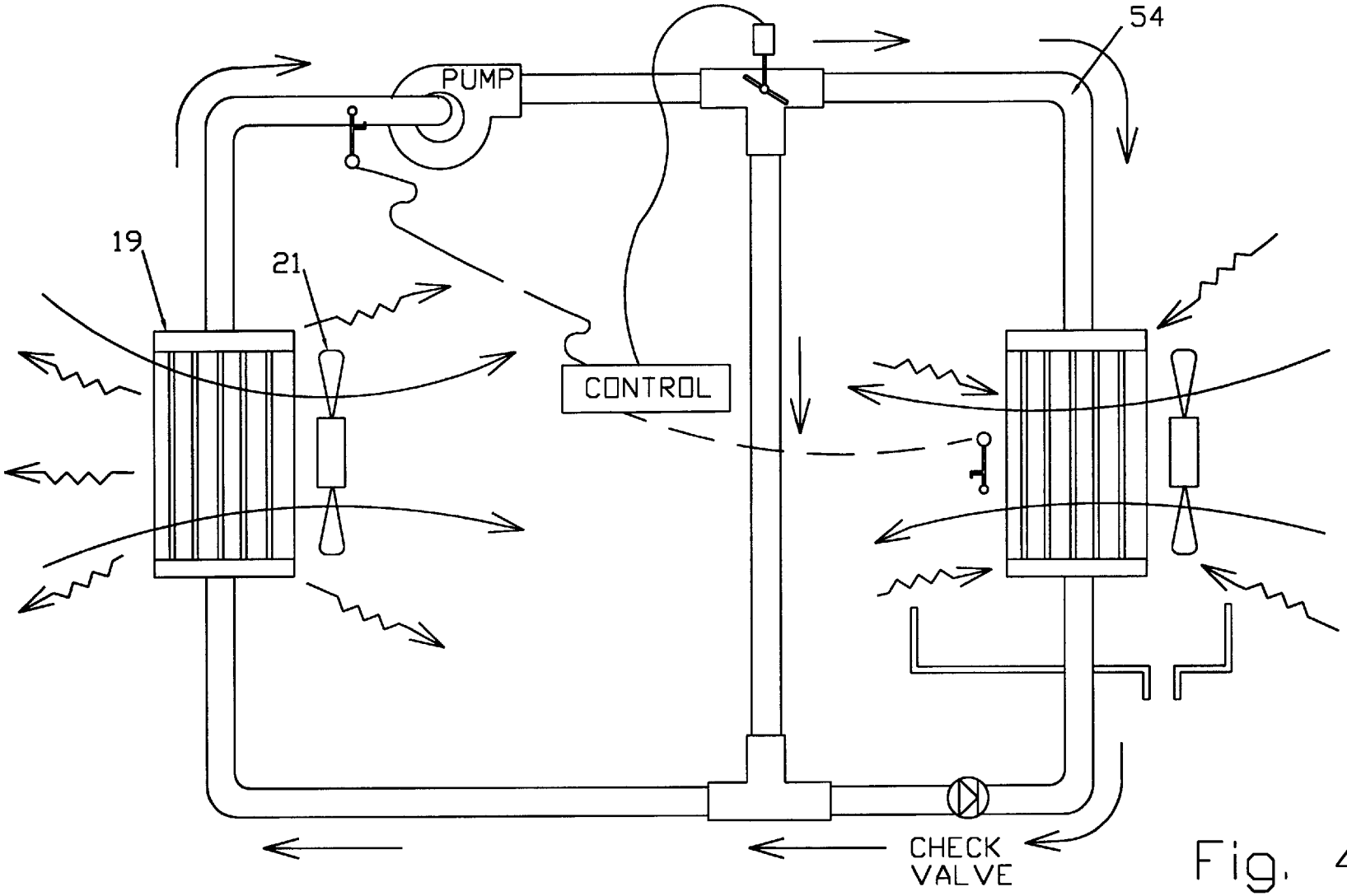
FIG. 4 is a schematic illustration of an alternate embodiment of the present invention, wherein dual heat exchangers are employed.
Figure 5:
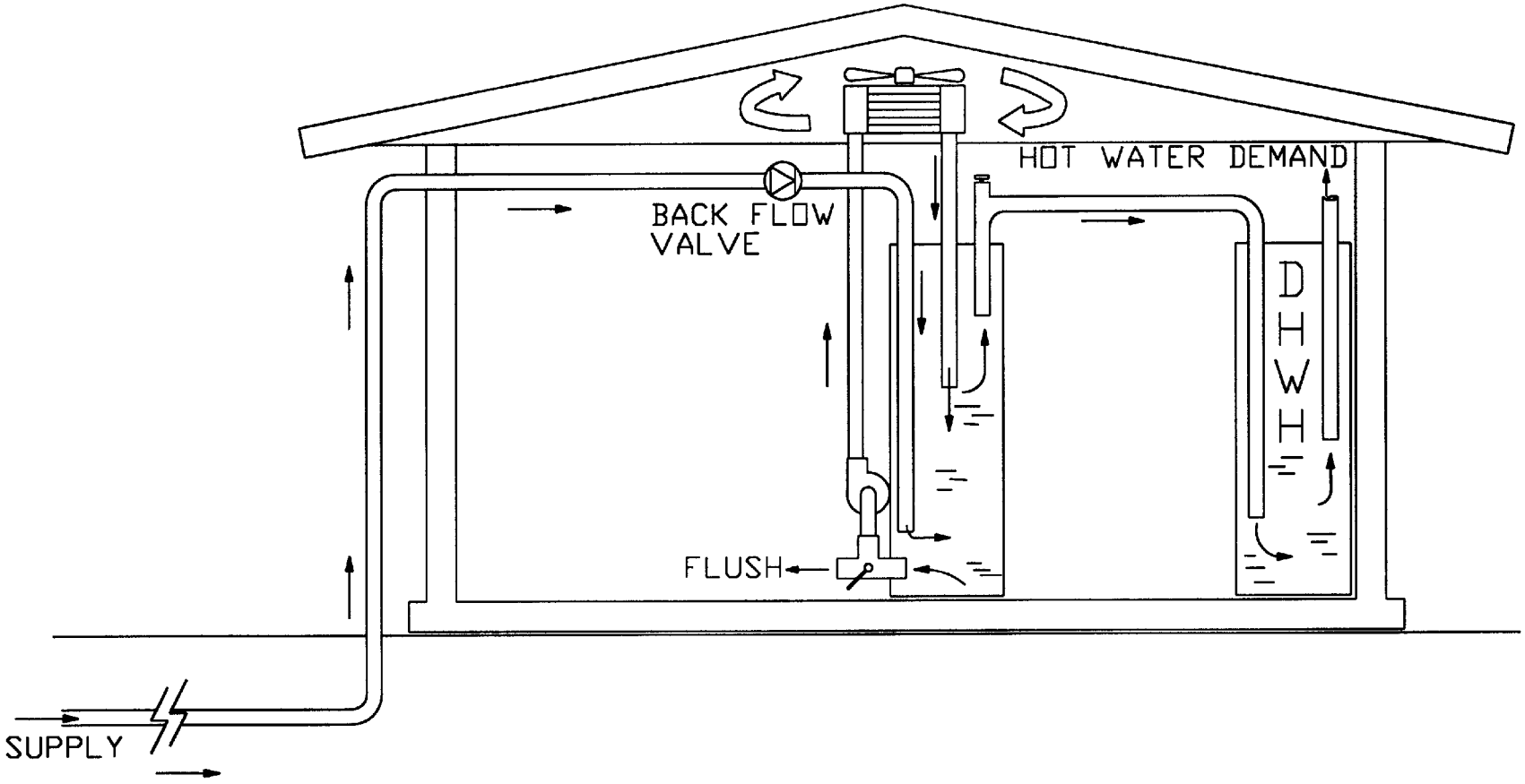
FIG. 5 is a front view of an alternate embodiment wherein the cooled media is a water input line.

In the alternative, the swimming pool may be replaced with any other cooled media such as sub-surface soil, well water, a pond, an evaporator, a water input line, or sea water. When sea water is the cooled media, the present invention may be utilized with a boat or off-shore drilling platform in lieu of a house. As an option, the present invention may further be used in combination with sprinklers. As shown in FIG. 4, the cooled media may be a air with a heat exchanger 19 and fan 21 associated therewith.

Located in the attic is a plastic heat exchanger 22 which may take one of various forms. Preferably, the heat exchanger includes a hollow plastic header 24 and a hollow plastic footer 26 with small plastic lines 28 therebetween. The header is divided into an input zone with a large input line and an output zone with a large output line. Note FIGS. 6A & 6B.

In alternate embodiments, the small lines of the heat exchanger are in a circular configuration 30, as shown in FIGS. 11A & 11B. FIG. 12 shows the small lines having a pair of portions 32 each with a semi-circular configuration. Each portion has a pair of ends connected to the input and output line, respectively. As an option, the heat exchanger may have an input line and an output line with a main flow line between the input and output lines and a balancing line at the junction of the input line and the main line and with a check valve in the output line.

The heat exchanger preferably has an associated fan 34. Such fan effects the movement of air within the heated attic air space across the heat exchanger. Associated therewith is a drain pan 36 positioned below the heat exchanger. The drain has a drainage outlet 38 for directing condensation generated by the heat exchanger to a location exterior of the house.

As shown in FIGS. 7–9, the fan may be included in various forms. FIG. 7 shows the fan comprising a propeller 40. FIGS. 8 & 9 show the fan comprising a blower 42 and squirrel cage fan 44, respectively. In the heat exchanger embodiments of FIG. 11A–12, the fan is preferably mounted in coaxial alignment with the heat exchanger.

Figure 10A:
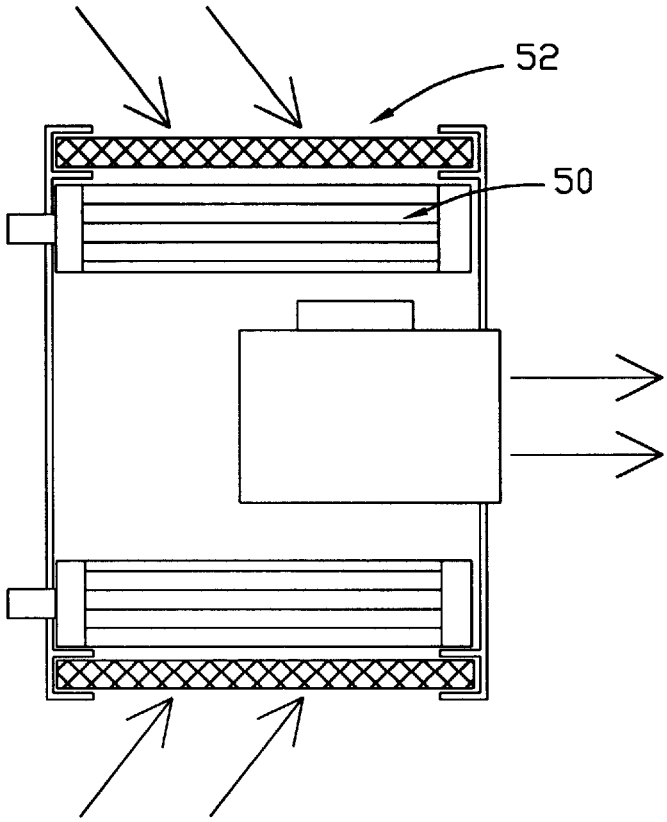
FIGS. 10A & 10B are illustrations of an alternate configuration of the heat exchanger, filter, and fan.
Figure 10B:
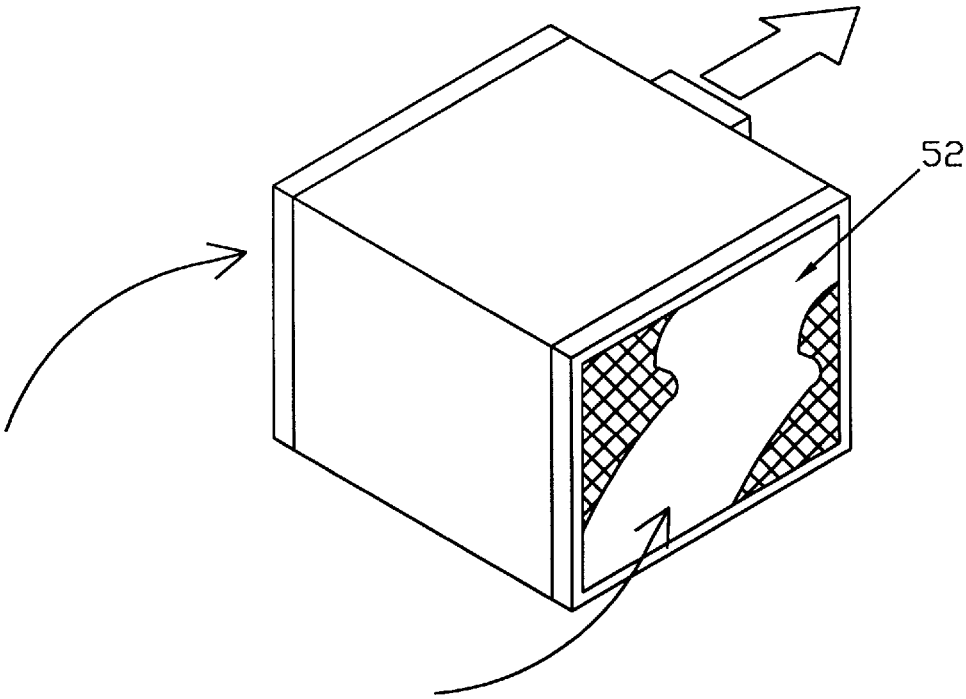

The fan and heat exchanger preferably has a filter 48 for filtering the air contacting the heat exchanger. As shown in FIGS. 7–9, the filter is positioned such that the fan resides between the heat exchanger and the filter. In the alternative, the filter is positioned so that a pair of heat exchangers 50 are located between a and a pair of filters 52 and a fan, as shown in FIGS. 10A & 10B.

Figure 3:
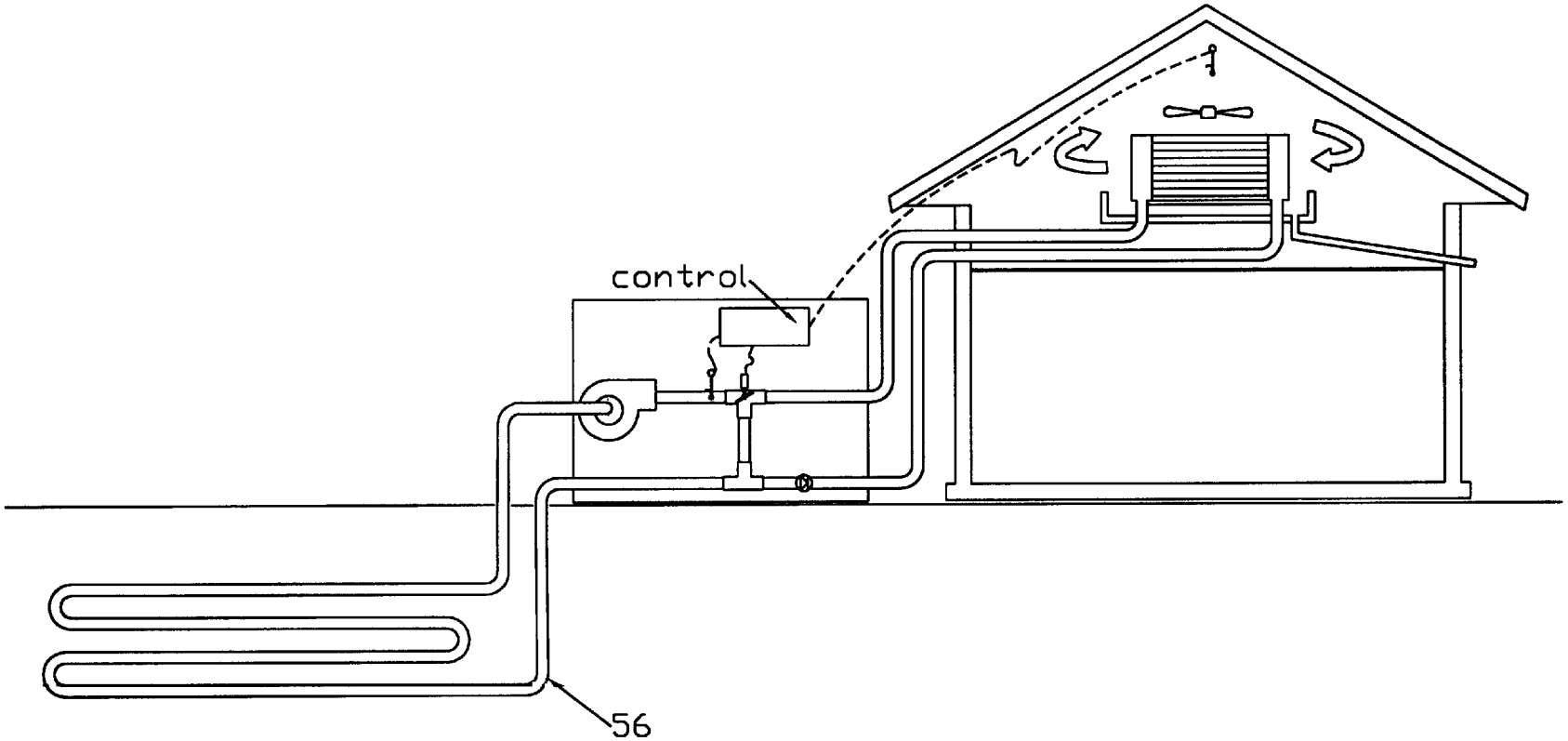
FIG. 3 is a front view of an alternate embodiment of the present invention with a closed pipe situated within the cooling media.

Also included is a plurality of plastic lines 54 coupling the heat exchanger and the cooled water of the swimming pool. It is of paramount criticality that the lines be formed of plastic since any other metallic material would be subject to corrosion due to the presence of chemicals in the swimming pool. In an alternate embodiment, however, a coiled pipe 56 may be situated within the swimming pool which is in closed fluidic communication with the plastic lines, thus protecting the lines from such corrosion. Note FIG. 3. Further, in the foregoing embodiment, other types of working fluid may be employed.

It should be noted that the lines include a first line 60 with an open end 62 in fluidic communication with the pool. The first line serves to convey cooled water from the heat exchanger in the attic to the swimming pool. A second line 64 is provided with an open end 66 in fluidic communication with the pool to convey water from the swimming pool to the heat exchanger in the attic. An associated pump 68 is included to effect the flow of water in a closed loop configuration between the swimming pool and the heat exchanger. By this structure, the entrapped heated attic air space is cooled to a lower temperature from the cooled water of the swimming pool while the temperature of the cooled water in the swimming pool will be heated to a higher temperature from the heated attic air space.

Figure 2:
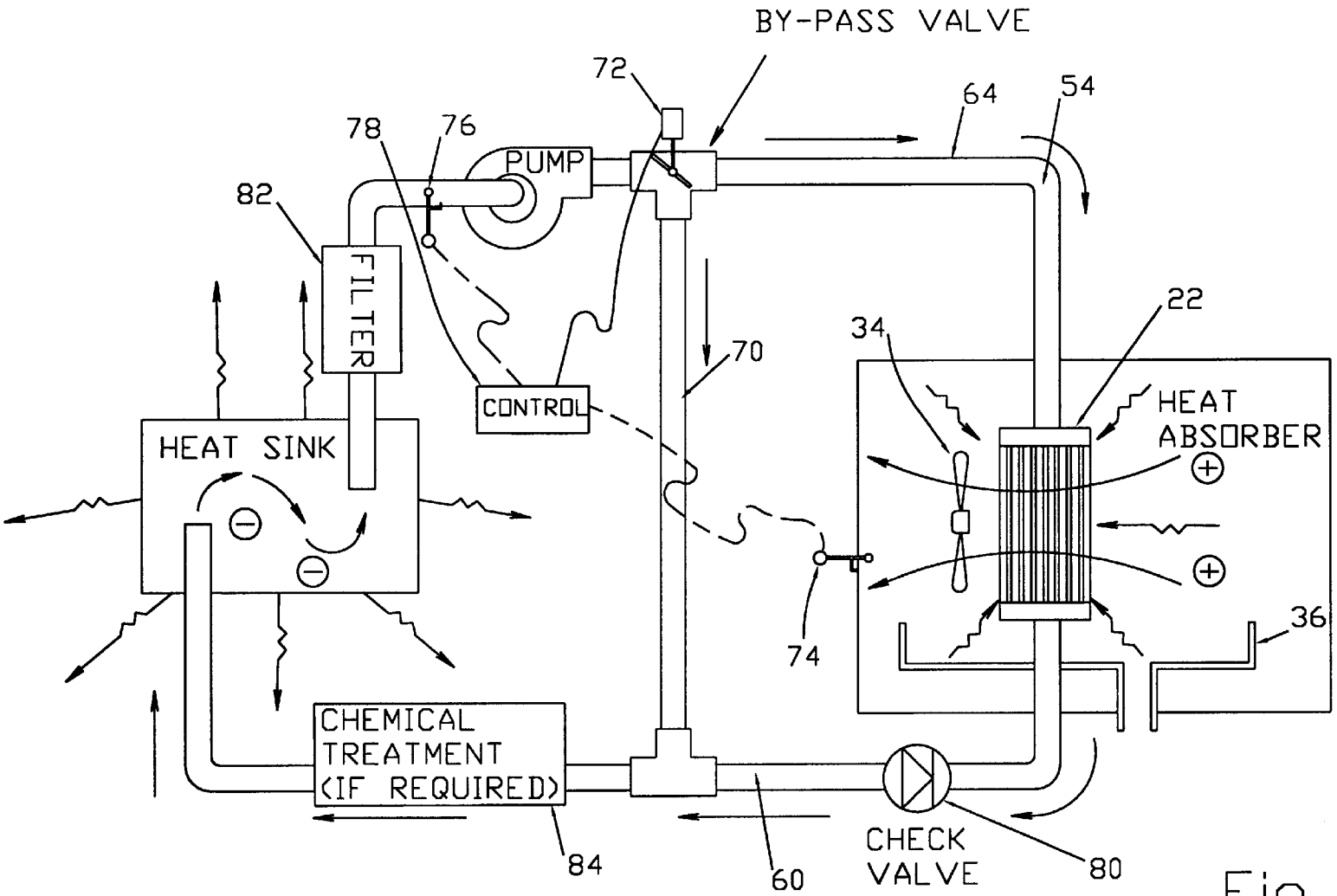
FIG. 2 is a schematic illustration of the system shown in FIG. 1.

With reference to FIGS. 1 & 2, an interconnect pipe 70 is shown to be connected between the first line and the second line at a point between the pump and the heat exchanger. Such interconnect is adapted for allowing fluidic communication between the first line and the second line at a location distant the swimming pool and exterior of the attic.

A control valve 72 is mounted at an interconnection between the second line and the interconnect for selectively redirecting the flow of cooled water from the swimming pool through the interconnect pipe. Such redirected fluid discharges directly into the swimming pool thereby bypassing the heat exchanger.

For detecting a first temperature of air flowing past the heat exchanger, a first temperature sensor 74 is mounted adjacent the heat exchanger. A second temperature sensor 76 is mounted on the second line between the open end and the pump for detecting a second temperature of the cooled water entering the heat exchanger from the swimming pool.

Connected between the valve, first temperature sensor and second temperature sensor is control means 78. In a first mode of operation, the control means is adapted to govern the control valve such that the flow of cooled water redirected from the swimming pool through the interconnect pipe is allowed while the flow of cooled water directed from the swimming pool to the heat exchanger is prevented. The control means remains in the first mode of operation only while either the second temperature deviates from a predetermined amount or a temperature differential between the first temperature and the second temperature deviates from a predetermined range indicative of preset conditions. Conversely, the control means is further adapted to govern the control valve for precluding the flow of cooled water redirected from the swimming pool through the interconnect pipe while allowing the flow of cooled water directed from the swimming pool to the heat exchanger when in a second mode of operation. The control means remains in the second mode of operation when the second temperature is approximately equal to the predetermined amount in combination with the temperature differential between the first temperature and the second temperature is within the predetermined range.

Also included is a check valve 80 mounted on the first line between the heat exchanger and the interconnect. The check valve is adapted for permitting only one way flow of the water through the first line, second line, and interconnect.

So that the present invention may be employed to maintain the swimming pool, a filter 82 is situated on the second line between the second temperature sensor and the open end thereof to prevent particles from entering the pump and further collecting the same for subsequent removal. Further, chemical treatment means 84 is positioned on the first line between the interconnect and the open end thereof for adding a predetermined amount of a chemical substance to the water flowing therepast.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved attic air conditioning system comprising, in combination:

a house having a living chamber with an imperforate roof located thereabove, the roof constituting the upper extent of the house with an entrapped heated attic air space located between the roof and the living chamber at a first temperature;

a swimming pool located in proximity to the house, the swimming pool being provided with a quantity of chlorinated cooled water at a second temperature lower than the first temperature;

a plastic heat exchanger located in the attic with an associated fan for the movement of air within the heated attic air space across the heat exchanger;

a drain pan positioned below the heat exchanger and having a drainage outlet for directing condensation generated by the heat exchanger to a location exterior of the house;

a plurality of plastic lines coupling the heat exchanger and the cooled water of the swimming pool, the lines including a first line with an open end in fluidic communication with the pool to convey cooled water from the heat exchanger in the attic to the swimming pool and a second line with an open end in fluidic communication with the pool to convey water from the swimming pool to the heat exchanger in the attic with an associated pump to effect the flow of water in a closed loop configuration between the swimming pool and the heat exchanger whereby the entrapped heated attic air space will be cooled to a lower temperature from the cooled water of the swimming pool while the temperature of the cooled water in the swimming pool will be heated to a higher temperature from the heated attic air space;

an interconnect pipe connected between the first line and the second line at a point between the pump and the heat exchanger for allowing fluidic communication between the first line and the second line at a location distant the swimming pool and exterior of the attic;

a control valve mounted at an interconnection between the second line and the interconnect for selectively redirecting the flow of cooled water from the swimming pool through the interconnect pipe for discharging into the swimming pool thereby bypassing the heat exchanger;

a first temperature sensor mounted adjacent the heat exchanger for detecting a first temperature of the air flowing past the heat exchanger;

a second temperature sensor mounted on the second line between the open end and the pump for detecting a second temperature of the cooled water entering the heat exchanger from the swimming pool;

control means connected between the valve, first temperature sensor and second temperature sensor, the control means adapted to govern the control valve for allowing the flow of cooled water redirected from the swimming pool through the interconnect pipe while precluding the flow of cooled water directed from the swimming pool to the heat exchanger upon at least one of the second temperature deviating from a predetermined amount and a temperature differential between the first temperature and the second temperature deviating from a predetermined range, the control means further adapted to govern the control valve for precluding the flow of cooled water redirected from the swimming pool through the interconnect pipe while allowing the flow of cooled water directed from the swimming pool to the heat exchanger when the second temperature is approximately equal to the predetermined amount and the temperature differential between the first temperature and the second temperature is within the predetermined range;

a check valve mounted on the first line between the heat exchanger and the interconnect for permitting only one way flow of the water through the first line, second line, and interconnect;

a filter situated on the second line between the second temperature sensor and the open end thereof to prevent particles from entering the pump and further collecting the same for subsequent removal; and chemical treatment means positioned on the first line between the interconnect and the open end thereof for adding a predetermined amount of a chemical substance to the water flowing therepast.

2. An air conditioning system comprising:

a chamber with a heated air space at a first temperature;

a single common heat sink located in proximity to the chamber, the heat sink being provided with cooled media at a second temperature lower than the first temperature;

a plastic heat exchanger located within the chamber with an associated fan means for the movement of air within the chamber across the heat exchanger; and a plurality of plastic lines coupling the heat exchanger and the cooled media, the lines including a first plastic line to convey water from the heat exchanger in the chamber to the cooled media and a second line to convey water from the cooled media to the heat exchanger in the chamber with an associated pump to effect the flow of water in a closed loop configuration between the cooled media and the heat exchanger whereby the heated chamber air space will be cooled to a lower temperature from the cooled water from the cooled media while the temperature of the cooled media will be heated to a higher temperature from the heated chamber air space.

3. The system as set forth in claim 2 wherein the chamber is an attic with an imperforate roof thereabove and the cooled media is swimming pool water.

4. The system as set forth in claim 2 wherein the chamber is an attic with an imperforate roof thereabove and the cooled media is water employed in the house.

5. The system as set forth in claim 2 wherein the chamber is a house with a roof thereabove and the cooled media is air.

6. The system as set forth in claim 2 wherein the cooled media is a body of water and situated therein is a pipe which is in closed fluidic communication with the plastic lines.

7. The system as set forth in claim 2 wherein the fan means comprises a blower.

8. The system as set forth in claim 2 wherein the fan means comprises a propeller.

9. The system as set forth in claim 2 wherein the fan means comprises a squirrel cage fan.

10. The system as set forth in claim 2 wherein the heat exchanger includes a hollow plastic header and a hollow plastic footer with a small plastic lines therebetween, the header being divided into an input zone with a large input line and an output zone with a large output line.

11. The system as set forth in claim 10 wherein the small lines are in a circular configuration.

12. The system as set forth in claim 11 wherein the fan means is mounted in coaxial alignment with the small lines.

13. The system as set forth in claim 10 wherein the small lines are in a pair of portions each with semi-circular configuration, wherein each portion has a pair of ends connected to the input and output lines, respectively.

* * * * *